US006769628B1

(12) United States Patent
Vaage et al.

(10) Patent No.: US 6,769,628 B1
(45) Date of Patent: Aug. 3, 2004

(54) TRANSPORTABLE TEXTURE APPLICATOR

(76) Inventors: Lauren Jay Vaage, P.O. Box 72389, Davis, CA (US) 95617; Gilbert Castillo, 1255 Charity La., Dixon, CA (US) 95620

( * ) Notice: Subject to any disclaimer, the term of this patent is extended or adjusted under 35 U.S.C. 154(b) by 0 days.

(21) Appl. No.: 10/452,168

(22) Filed: May 30, 2003

Related U.S. Application Data

(63) Continuation-in-part of application No. 09/817,450, filed on Mar. 26, 2001.

(51) Int. Cl.[7] ..... B05B 9/08

(52) U.S. Cl. ..... 239/152; 239/153; 239/154; 239/340; 239/345; 239/346; 239/365; 239/373; 239/375; 239/DIG. 14

(58) Field of Search ..... 239/152, 153, 239/154, 340, 345, 346, 364, 365, 367, 373, 375, 378, DIG. 14, 376, 377, 379; 222/175

(56) References Cited

U.S. PATENT DOCUMENTS 585,503 A 6/1897 Black
1,342,212 A 6/1920 Hainsey
1,765,398 A * 6/1930 Birknmaier ..... 239/308
1,979,135 A 10/1934 Altenburger et al.
RE20,425 E 6/1937 Schori
2,083,039 A 6/1937 Searls
2,958,155 A 11/1960 Emmerich
3,802,511 A 4/1974 Good, Jr.
3,945,571 A 3/1976 Rash
4,702,416 A 10/1987 Pagliai et al.
4,848,660 A 7/1989 O'Connell
5,054,687 A * 10/1991 Burns et al. ..... 239/373
5,429,305 A 7/1995 Munsey
5,636,791 A 6/1997 Leer
5,752,661 A 5/1998 Lewis
5,785,245 A * 7/1998 Tedders, Jr. et al. ..... 239/9
5,984,206 A 11/1999 Leitzel et al.

* cited by examiner

*Primary Examiner*—Robin O. Evans
(74) *Attorney, Agent, or Firm*—Bernhard Kreten

(57) ABSTRACT

A compressed air sprayer used for applying textured material to surfaces, in which the reservoir of texture material is transported on the operator's body using an integrated harness system. The sprayer tank may rest upright on the ground when not being worn, and may be filled in this orientation without damaging delivery components attached to the bottom of the tank. A handle is provided on the tank for proper positioning and transport.

13 Claims, 6 Drawing Sheets

TRANSPORTABLE TEXTURE APPLICATOR

REFERENCE TO RELATED APPLICATIONS

This is a continuation-in-part of U.S. patent application Ser. No. 09/817,450, status: pending, here incorporated by reference.

FIELD OF THE INVENTION

The following invention is generally related to instrumentalities and methodologies in texture materials. More specifically, the instant invention is directed to a method and apparatus for the pressurized application of texture materials to a work surface.

BACKGROUND OF THE INVENTION

Tools have been fashioned to convey texture materials through systems of differently arranged components in order to release the material with a stream of pressurized air utilized as a vehicle that transports and atomizes the material, then deposits it onto a work surface as a form of texture. However, these texture applicators of past designs can prevent the average person, when working alone, from producing a sprayed on texture appearance on a large to small work surface area that would be considered structurally and aesthetically acceptable in a manner considered safe, efficient, or cost effective.

Described in brief are four texture applicator designs:

(1) A texture applicator that is mounted on a vehicle bed or towed behind a vehicle as a trailer. These are large, expensive, and complex, comprised of a large motorized hopper that mixes the texture material and pumps the material through a hose long enough to reach the work surface. Accompanying the entire length of the material hose is a compressed air line that atomizes the material onto the work surface. This air line is connected to an air compressor near the hopper.

Since the work surface is generally out of sight of the hopper, additional persons must attend to the hopper and negotiate the material hose and the compressed air line around obstacles while the material hose is used.

(2) A texture applicator that manually atomizes premixed texture materials onto a work surface. This is like a garden pesticide sprayer, in which an operator creates air pressure by forcefully pumping a piston with one hand while the other hand grips the piston housing (having an attached material reservoir) to direct the spray of material onto the work surface.

This type of texture applicator is limited to smaller work surface areas, because (a) the reservoir capacity is limited, and (b) a steady amount of physical exertion is necessary to provide a uniformly textured appearance on the work surface.

(3) A texture applicator that has a reservoir (hopper) mounted atop a nozzle (spray gun), which relies on gravity to introduce a premixed texture material into the spray gun. The spray gun is linked to an air compressor with an air line to atomize the material onto the work surface.

While providing a relatively inexpensive tool that applies the material to a greater surface area, a less skilled operator will encounter encumbering factors that impede desired results. One hand actuates the spray gun trigger, the other hand braces the built-in hand grip on the hopper necessary to support and right the filled hopper, and no hand is free to adjust the material flow controls located on the spray gun, to regulate air pressure, or to perform work-related tasks. The rate that a texture applicator of this design can apply the material when the hopper is full is 50% or less than that of applicators that use a motorized pump or air pressure to force the material into the spray gun. The rate is lowered even further when the spray is directed at an angle, because the material stored in the hopper shifts and lessens the downward pressure over the material intake orifice for the spray gun. For similar reasons, when directing the spray at a ceiling, the operator must install an angled coupler between the hopper and the spray gun for the flow of material to continue into the spray gun. Spillage may also occur in these orientations.

(4) A texture applicator that has a standing hopper to contain premixed texture material and a motorized pump or a pressurized tank forces the material through a hose connected to a spray gun that is linked to an air compressor with an air line to atomize the material onto a work surface. This system provides a tool for applying texture materials to small and large surface areas in greater quantity and with better spray direction control. However, various aspects of this type of system limit use and availability. Though they are portable by means of a wheeled dolly or carrying handle, these applicator systems are awkward and heavy for one person to lift, even without the added texture material. Work surface areas out of arm's reach require moving the hopper or coupling lengths of compressed air line and material hose together, which requires more material in the hopper. This produces a system with a higher overall weight that has more drag resistance to the operator's movements. These systems are expensive to purchase and maintain and often require specialized parts, tools, and technicians because of their complexity. Repairs in the field are difficult and create lengthy delays. Finally, this type of machine is more difficult to clean, which leaves small portions of dried texture material in the system. These small pieces of material may then break loose and clog the spray tip during operation.

SUMMARY OF THE INVENTION

The present invention is distinguishable over the prior art in that it allows one person to operate a texture applicator in a safe manner, while providing a means to achieve a uniform application of texture material on a work surface.

More specifically, the instant invention allows an operator to fill a tank with premixed texture material and to apply it to a work surface with a spray gun. The tank is supported on the operator's back with a built-in harness. A separate air compressor is connected to a three-way nipple having two outputs, or to a regulator that operates as such a three-way nipple would operate. Air pressure is supplied to the tank, keeping the texture materials under pressure. This pressure forces texture material into the material hose line in a constant manner. An air line also runs along the material hose line, terminating at the spray gun, to atomize the texture material as it exits the nozzle. The material contacts the work surface, forming a textured profile. Should the connection be made by a regulator, the operator may more directly control the air pressure in the tank and in the line while applying the texture material.

OBJECTS OF THE INVENTION

Accordingly, it is a primary object of the present invention to provide a new and novel device and method for applying texture materials in a safe manner while providing a uniform output.

It is a further object of the present invention to provide a device and method as characterized above which may safely be utilized by a single person.

It is a further object of the present invention to provide a device and method as characterized above which lessens waste materials in industrial applications.

It is a further object of the present invention to provide a device and method as characterized above which allows an operator to exert fine control over a texture application system.

It is a further object of the present invention to provide a device and method that is an alternative to cumbersome over-mechanized texture application devices.

It is a further object of the present invention to provide a device and method as characterized above that is accessible by virtue of its reduced cost and ease of repair.

Viewed from a first vantage point, it is an object of the present invention to provide an apparatus for applying texture material to a surface, comprising, in combination: a tank; external air compression means attached to the tank; delivery means connected to the tank and the external air compression means; transport means interconnecting the tank, the external air compression means, and the delivery means; and harness means integrated with the tank, wherein the harness means support the apparatus on an operator.

Viewed from a second vantage point, it is an object of the present invention to provide an apparatus for delivering premixed material to a surface, comprising, in combination: a tank; external air compression means attached to the tank; delivery means connected to the tank and the external air compression means; transport means interconnecting the tank, the external air compression means, and the delivery means; and pressure regulation means, the pressure regulation means located within an operator's reach, wherein pressure in the transport means is adjusted by an operator.

These and other objects will be made manifest when considering the following detailed specification when taken in conjunction with the appended drawing figures.

DESCRIPTION OF PREFERRED EMBODIMENTS

Figure 1:
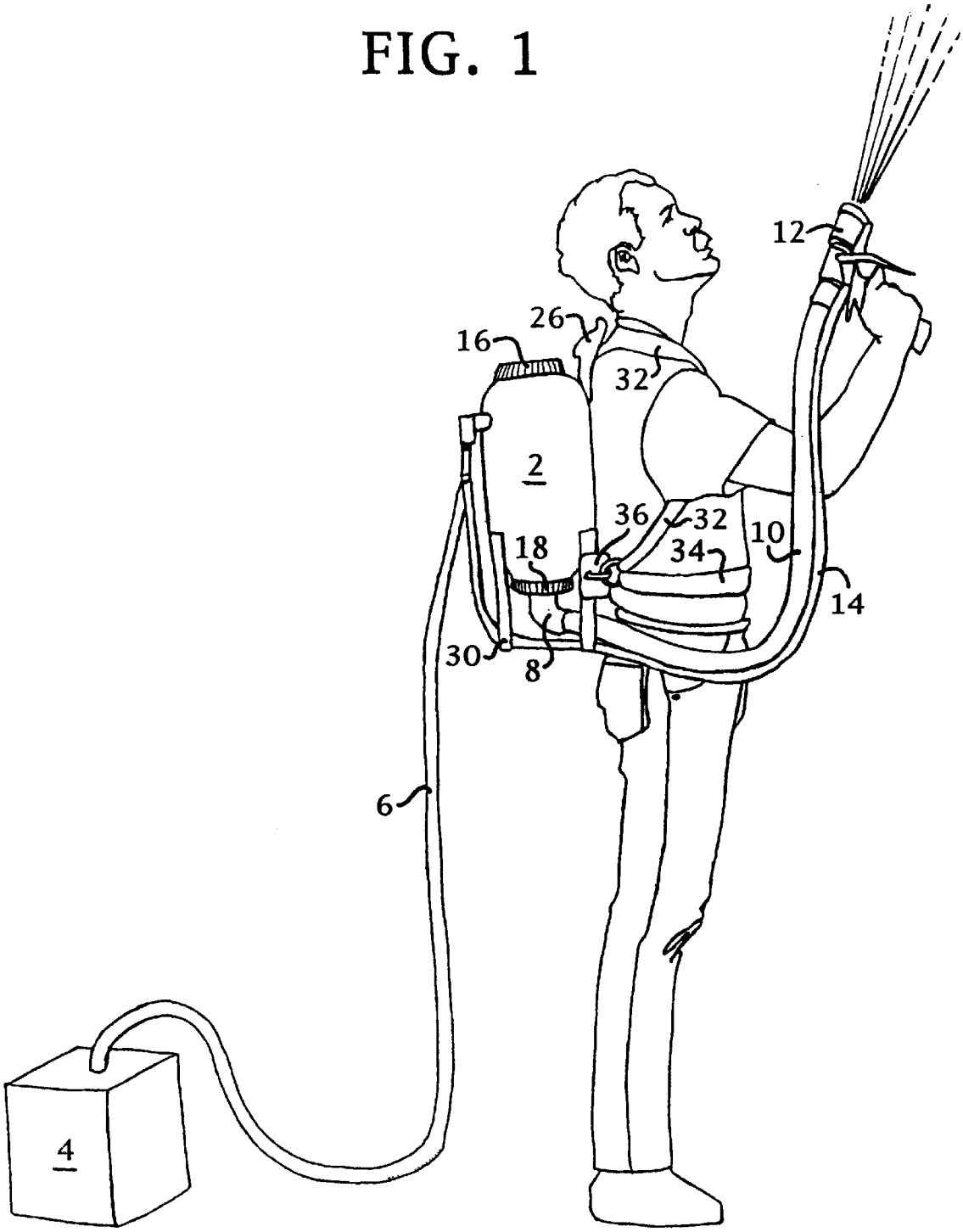
FIG. 1 shows one embodiment of the texture applicator in use.
Figure 2:
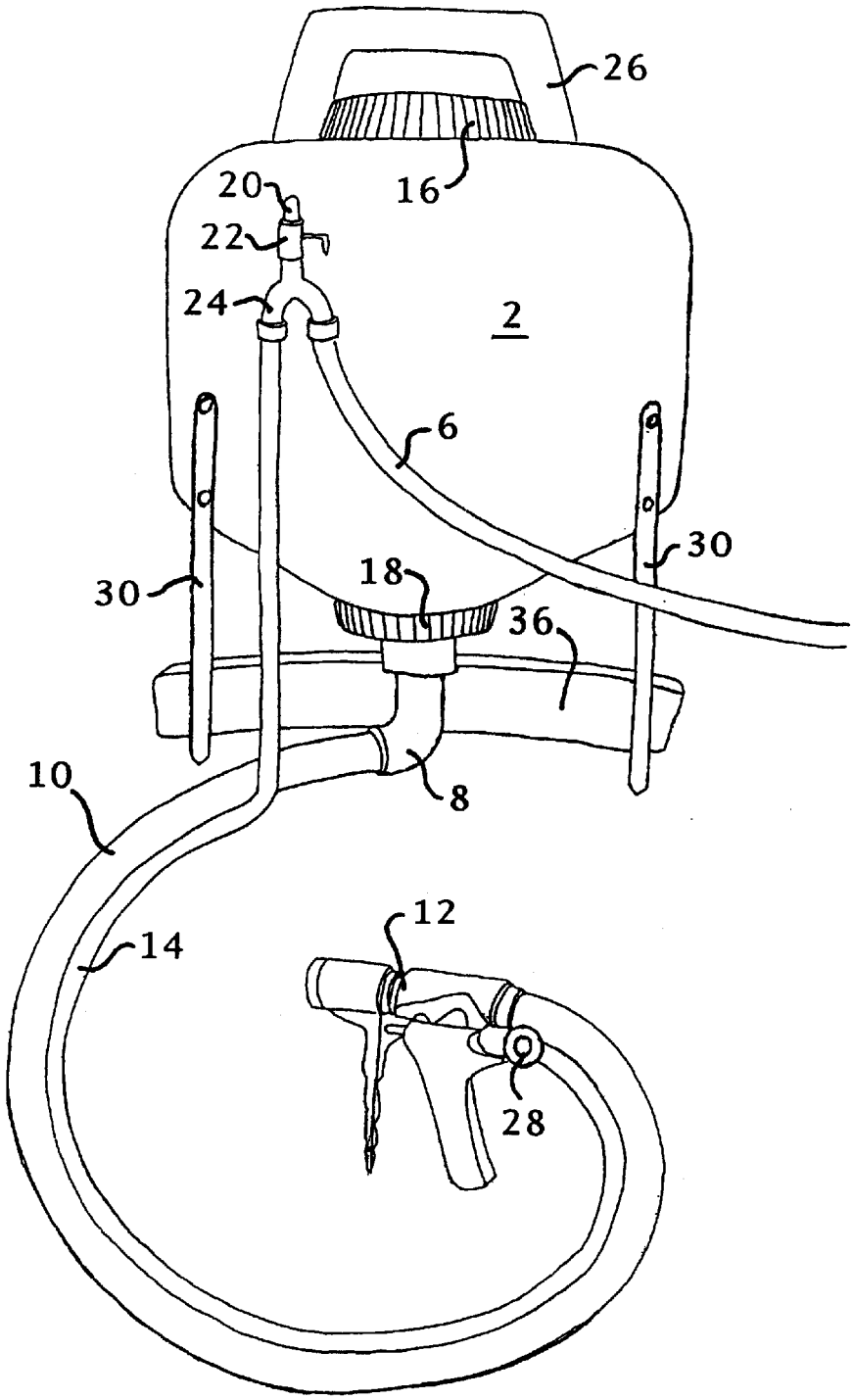
FIG. 2 is a front perspective view of the texture applicator.
Figure 3:
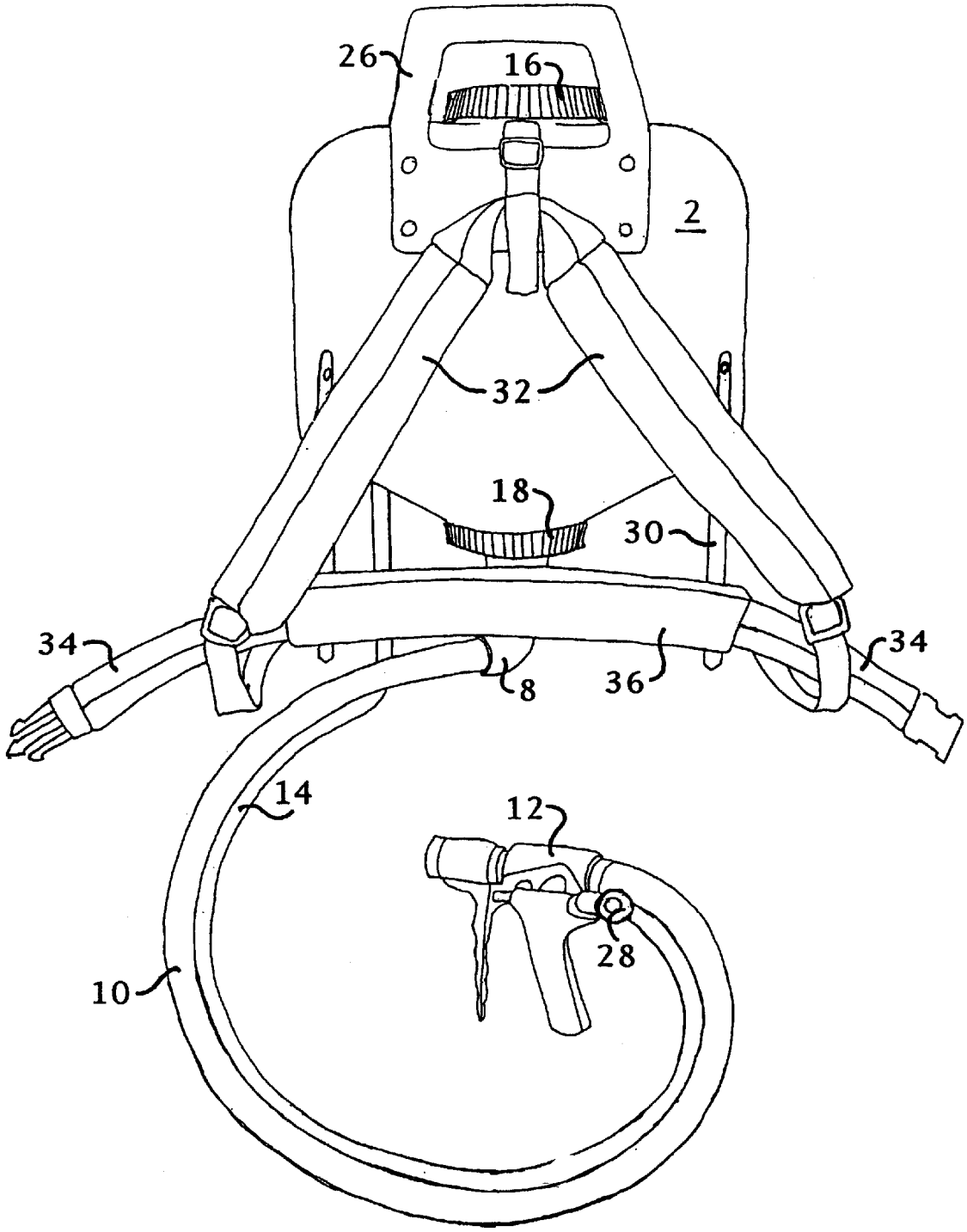
FIG. 3 is a back perspective view of the texture applicator.

Considering the drawings, wherein like reference numerals denote like parts throughout the various drawing figures, reference numeral 50 as shown in FIG. 2 is directed to the texture applicator according to the present invention.

In its essence, the texture applicator 50 includes a tank 2, which is filled with a premixed texture compound. The tank 2 is tapered for maximum material flow, and is sealed with a top cover 16 and a bottom cover 18. The orifices under the covers are large to aid in thorough cleaning and refilling. Air compressor 4 supplies pressurized air to the tank 2 and to the spray gun 12 through primary line 6. Air compressor 4 is preferably equipped to travel with the operator, rather than being stationary. The primary line 6 and the spray gun line 14 are connected to two legs of a three-way connector 24, which creates a bypass. Constant pressure is thus maintained in the spray gun line 14. The spray gun 12 monitors its own pressure with an attached pressure regulator 28, and the spray gun line 14 descends from the three-way connector 24 to run alongside the material hose 10 to minimize tangling of the lines and allow the operator to have more control in directing the spray. The material hose need not be longer than the operator's reach. The remaining connection of the three-way connector 24 leads to an air shut off valve 22, which further connects to tank 2 through air inlet 20. The pressurized air forces the premixed texture material down through the bottom cover 18, which is fitted with a swiveling orifice 8 connected to the material hose 10. The material proceeds through material hose 10 to spray gun 12.

For the material to reach the work surface in texture form, it must be broken down into particulate form by introducing the material into a stream of pressurized air. The pressurized air is also the vehicle for scattering the material onto the work surface. When the operator releases material (from the material hose 10) and air (from the spray gun line 14) together, atomization and scattering occur. The level of material remaining in the tank 2 may be determined by sight if the tank 2 is composed of a translucent material. If the tank 2 is opaque, a portal or other device may be used to determine the level of material remaining.

The tank 2 is equipped with supports 30 that keep the tank 2 in an upright position and protect the swiveling orifice 8 (and its connection to the material hose 10) located on bottom cover 18. The tank 2 may be filled in this position. A handle 26 is provided for easy lifting and transport. An integrated harness system 32,34,36 is also present, comprising shoulder straps 32, a waist belt 34 and a back brace 36, for protecting the operator and supporting the texture applicator 50 while it is i n operation.

Figure 4:
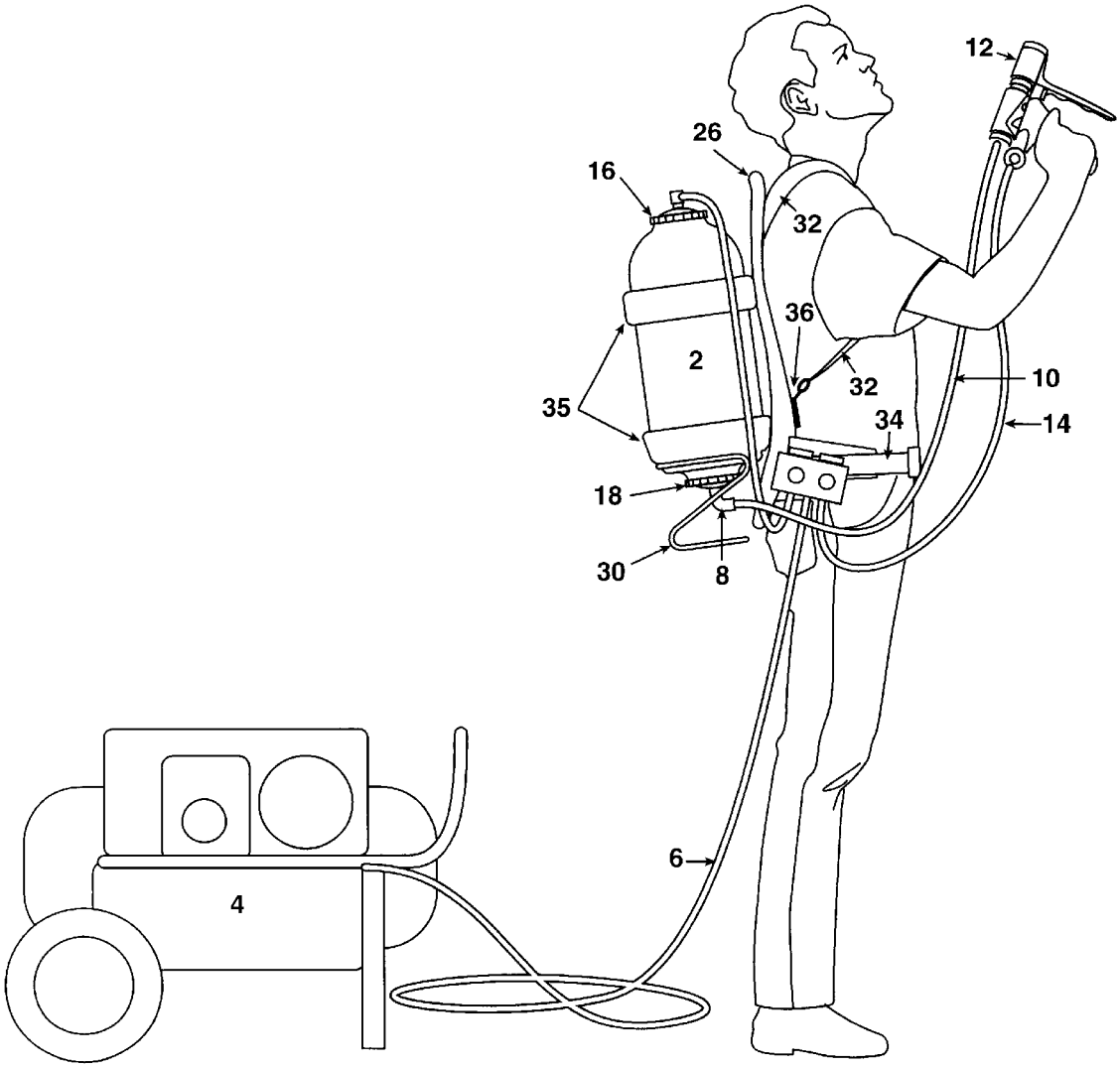
FIG. 4 shows an alternate embodiment of the texture applicator.
Figure 5:
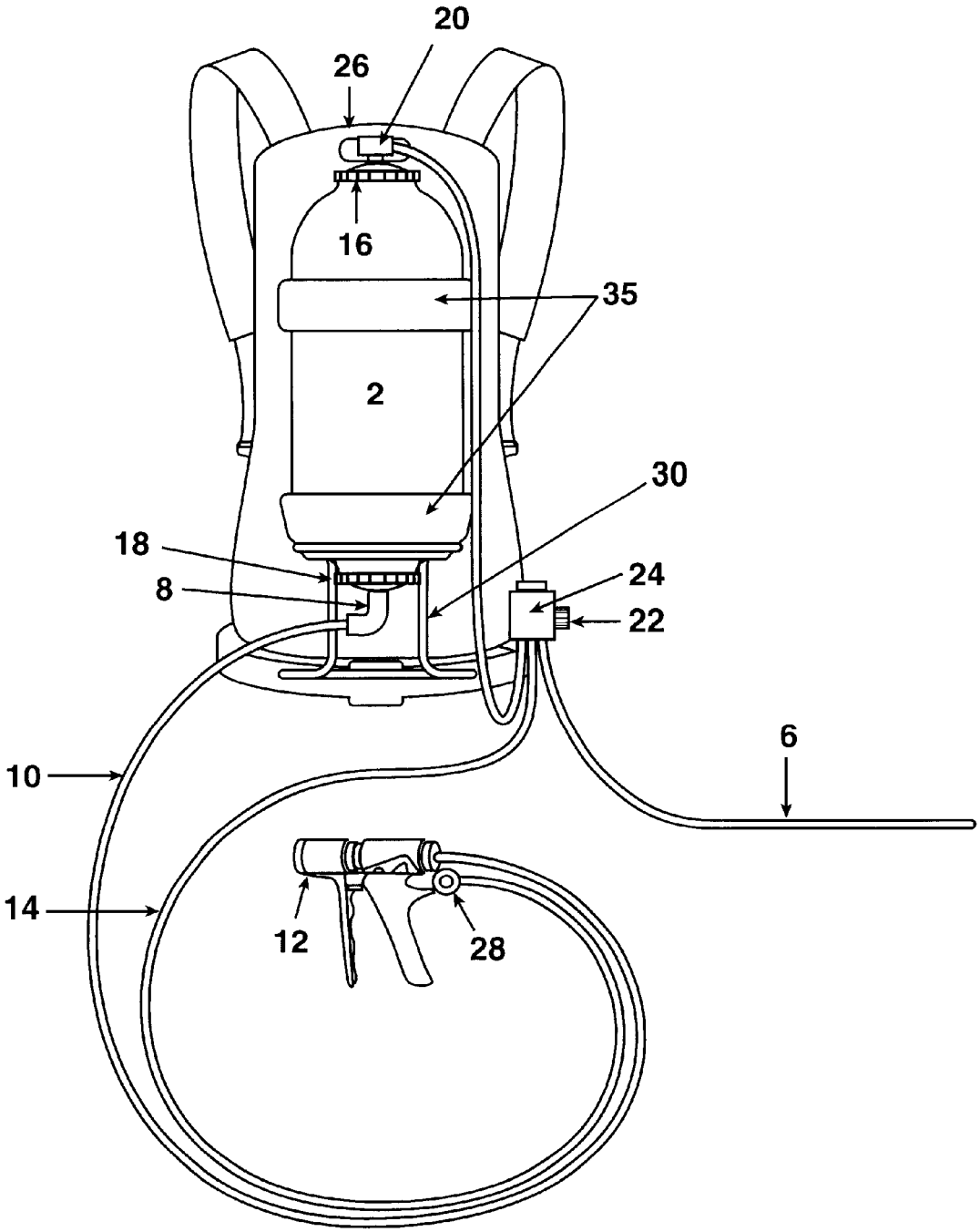
FIG. 5 is a front perspective view of the alternate embodiment.
Figure 6:
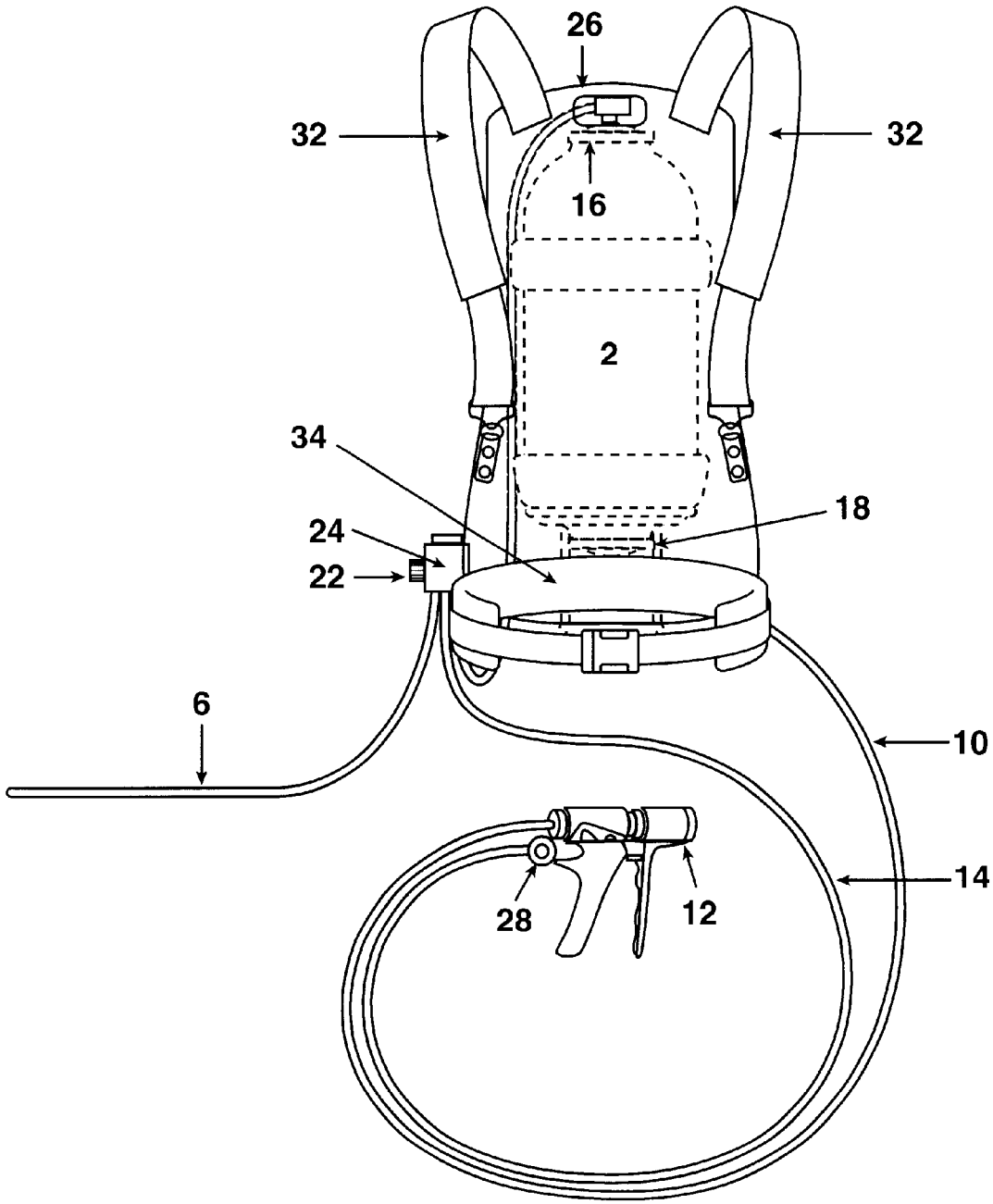
FIG. 6 is a back perspective view of the alternate embodiment.

An alternate embodiment is pictured in FIGS. 4,5,6. Again, tank 2 is filled with premixed texture material and sealed with a top cover 16 and a bottom cover 18. Air compressor 4 introduces pressurized air into primary line 6. Primary line 6 leads into a three-way connector 24 that divides the output into two lines: an air inlet 20 and a spray gun line 14. Air inlet 20 supplies pressurized air to tank 2, and spray gun line 14 supplies pressurized air directly to the spray gun 12. Airflow in spray gun line 12 is controlled by the shut off control 22, which is mounted on the harness assembly 32,34,36.

A separate shut off control 22 is attached to the air inlet 20 to allow operator control of material flow from the tank 2 to the spray gun 12. Air inlet 20 connects to the tank 2 through top cover 16. Air pressure enters the tank 2 and forces material therewithin down through swiveling orifice 8, integrated into the bottom cover 18, out of the tank 2 and into material hose 10. Material hose 10 connects the tank 2 to the spray gun 12. Spray gun 12 is preferably a hand-operated, trigger-activated nozzle. The shut off controls 22 may be replaced with adjustable pressure control valves to allow an operator greater control over the pressure delivered to the output lines.

Material hose 10 and spray gun line 14 are each connected to spray gun 12. The connection from spray gun line 14 to the spray gun 12 includes an attached pressure regulator 28, such that spray gun 12 monitors its own pressure. Material from the tank 2 is forced into the spray gun 12 by the pressurized air in the air inlet 20, and is combined with the pressurized air in the spray gun line 14. The pressurized air separates the material into small particles and also propels those particles onto the work surface. The pressure in the spray gun line 14 determines the particle size.

Tank 2 also features supports 30, which enable it to stand upright without damaging the swiveling orifice 8 or the material hose 10. The supports 30 may be used whether or not the tank 2 is attached to the harness assembly 32,34,36.

The harness assembly 32,34,36 is preferably backpack-style, having a back brace 36 that sits adjacent the operator's back and holds the tank 2, and shoulder straps 32 and a waist belt 34 to support the tank 2 on the operator's body. Tank 2 is held in said harness assembly using restraints 35. Tanks are replaceable on the back brace 36 and may be switched out when empty or if a different material application is desired; refilling at the job site is not necessary. Handle 26 on back brace 36 allows for easy transport of the entire structure.

Moreover, having thus described the invention, it should be apparent that numerous structural modifications and adaptations may be resorted to without departing from the scope and fair meaning of the instant invention as set forth hereinabove and as described hereinbelow by the claims.

We claim:

1. An apparatus for applying texture materials onto a work surface, comprising, in combination:

a tank having a top end and a bottom end, the top and bottom ends each having a tapered profile, the tank further including:

orifices in each of said top end and said bottom end, and sealable cover means on said top orifice and said bottom orifice, the bottom orifice cover having swivel attachment means;

external pressurization means connected to but separate from said tank, wherein contents of said tank are maintained under pressure;

delivery means connected to said swivel attachment means, wherein pressurized contents of said tank are delivered to a work surface;

handle means on said tank; and harness means integrated with said tank and separate from said handle means, wherein the apparatus may be supported on an operator during operation.

2. The apparatus of claim 1 wherein said tank includes support members on said bottom end, wherein said tank is kept upright and does not rest on said swivel attachment means; wherein said handle means are located at said top end of said tank; and wherein said harness means integrated with said tank comprises, in combination: shoulder straps, a waist belt, and a back brace.

3. The apparatus of claim 1 wherein said tank is composed of a translucent material.

4. The apparatus of claim 1 wherein said tank further includes a portal to display content level inside said tank.

5. An apparatus for applying texture materials onto a work surface, comprising, in combination:

a tank having a top end and a bottom end, the top and bottom ends each having a tapered profile, the tank further including:

orifices in each of said top end and said bottom end, sealable cover means on said top orifice and said bottom orifice, the bottom orifice cover having swivel attachment means;

pressurization means connected to said tank, wherein contents of said tank are maintained under pressure;

delivery means connected to said swivel attachment means, wherein pressurized contents of said tank are delivered to a work surface;

handle means on said tank; and harness means integrated with said tank and separate from said handle means, wherein the apparatus may be supported on an operator during operation;

wherein said pressurization means include a three-way transport means having one leg connected to an air shutoff valve, said air shutoff connected to an air inlet orifice on said tank; a second leg connected to an air pressure supply line; and a third leg connected to pressure regulation means attached to said delivery means.

6. The apparatus of claim 5 wherein said tank is composed of a translucent material.

7. The apparatus of claim 5 wherein said tank further includes a portal to display content level inside said tank.

8. An apparatus for applying texture material to a surface, comprising, in combination:

a tank having gauge means, said gauge means to indicate level of material remaining inside said tank, said tank having an inlet and an outlet and sealable covers on said inlet and said outlet, said outlet cover having swivel attachment means;

external air compression means attached to and separate from said tank;

delivery means connected to said tank and said external air compression means;

transport means operatively coupling said tank, said external air compression means, and said delivery means; and harness means integrated with said tank, wherein said harness means support the apparatus on an operator, whereby the texture material is applied to the surface from said delivery means by virtue of said air compression means operating on the texture material in said tank and at said delivery means.

9. The apparatus of claim 8 wherein said tank further comprises upright support means, said upright support means having clearance for said swivel attachment means.

10. The apparatus of claim 8 wherein said transport means further comprise a three way connector, wherein said three way connector divides compressed air into one stream leading to said tank and another stream leading to said delivery means.

11. The apparatus of claim 10 wherein said transport means further comprises pressure regulation means, said pressure regulation means located within an operator's reach, wherein pressure in said transport means is adjusted by an operator.

12. An apparatus for delivering premixed material to a surface, comprising, in combination:

a tank, said tank having an inlet and an outlet and sealable covers on said inlet and said outlet, said outlet cover having swivel attachment means;

external air compression means attached to said tank;

delivery means connected to said tank and said external air compression means;

transport means operatively coupling said tank, said external air compression means, and said delivery means; and pressure regulation means, said pressure regulation means located within an operator's reach, wherein pressure in said transport means is adjusted by an operator.

13. An apparatus for applying texture materials to a work surface, comprising, in combination:

a tank having a top end and a bottom end, the top and bottom ends each having a tapered profile, the tank further including:

orifices in each of said top end and said bottom end, and sealable cover means on said top orifice and said bottom orifice, the bottom orifice cover having swivel attachment means;

a tank support system, comprising, in combination:

means for restraining said tank, wherein said tank is replaceable;

integrated handle means;

upright support means, wherein said tank is maintained in a stable upright position without resting on said swivel attachment means; and harness means, wherein the apparatus may be supported on an operator during operation;

external pressurization means connected to but separate from said tank, wherein contents of said tank are maintained under pressure;

delivery means connected to said swivel attachment means, wherein pressurized contents of said tank are delivered to a work surface; and pressure regulation means connected to said delivery means, said pressure regulation means located within an operator's reach.

* * * * *